United States Patent [19]

Anderson et al.

[11] 4,414,036

[45] Nov. 8, 1983

[54] SANITIZER SYSTEM AND SANITIZING METHOD FOR CARBONATED BEVERAGE CONTAINER FILLER MACHINE

[76] Inventors: Frank E. Anderson, 1717 Queensbury Way; Robert A. Martin, Rte. #5, Box 406, both of Fort Smith, Ark. 72901

[21] Appl. No.: 303,354

[22] Filed: Sep. 18, 1981

[51] Int. Cl.[3] ..... B08B 9/00

[52] U.S. Cl. ..... 134/23; 134/166 R; 141/98

[58] Field of Search ..... 134/166 C, 169 R, 169 C, 134/23; 137/238, 237; 141/1, 89, 90, 91, 98, 392; 222/148

[56] References Cited

U.S. PATENT DOCUMENTS

| | | | |
|---|---|---|---|
| 2,847,043 | 8/1958 | Sommers | 141/305 |
| 3,430,639 | 3/1969 | Roberts | 141/91 X |
| 4,024,896 | 5/1977 | Ishioka et al. | 141/91 X |
| 4,136,719 | 1/1979 | Kronseder | 141/91 X |

*Primary Examiner*—Stephen Marcus
*Assistant Examiner*—Mark Thronson
*Attorney, Agent, or Firm*—Robert R. Keegan

[57] ABSTRACT

A sanitizing method and a sanitizer system to be attached to a conventional circular bottle filling machine as used for filling beverage bottles, the system including a plurality of collector manifolds, each manifold being adapted to collect sanitizing liquid from a plurality of adjacent filler valves, there being a sufficient number of manifolds with plural valve engaging tubes to accommodate every filler valve of a particular machine; the manifolds are connectable by flexible hoses to a rotating collector which is preferably permanently installed at the top of the bottle filler machine so that the entry ports of the collector rotate with the rotating conveyor table of the machine and the exit port of the collector is from a stationary portion thereof. There is a provision for passage of carbon dioxide gas through the center of the collector in cases where the bottle filler machine employs an overhead supply conduit for carbon dioxide to maintain carbonation in the beverage in the filler bowl. Jacks are provided for the manifolds to hold them firmly up against the seals of the filler valves. Hoses are connectable to the manifolds by quick connect fittings and the rotating table is provided with retainers to hold the ends of the hoses while the sanitizer system is not in use and the machine is being used in a normal filling operation. The manifolds are completely removable and there is no modification required to the filler valves or other parts of the machine which might interfere with the normal filling operation.

13 Claims, 6 Drawing Figures

SANITIZER SYSTEM AND SANITIZING METHOD FOR CARBONATED BEVERAGE CONTAINER FILLER MACHINE

The present invention relates to apparatus and methods to periodically hot sanitize carbonated beverage container filler machines to give maximum assurance that any bacterial, mold, or yeast contamination has been eliminated. More specifically, the present invention relates to accessory equipment which can be added to a conventional bottle filler machine to provide the capability of sanitizing all product contacting components at a sterilizing temperature of at least 185° F., for a time period necessary to insure sterility of all such components and freedom from contamination by any live micro-organisms.

Some bottle filler machines of recent design have provided built-in capability for high-temperature sanitizing of components in contact with the product. However, many older machines do not have this built-in hot sanitizing capability. Apparatus according to the present invention permits the addition of hot sanitizing capability to an existing bottle filler machine in a manner which is inexpensive, convenient, simple and highly effective.

The need for more effective sanitizing procedures in carbonated beverage container filler machines comes about in part because of the introduction of beverages in this country which do not have the high acid content that was common in popular beverages of previous years. The recent non-acidic beverages provide a much more favorable environment for the growth of micro-organisms and thus require more elaborate precautions to prevent contamination of the product.

The most acceptable procedure for insuring sterility of the equipment components in contact with the product is to expose such components to an elevated temperature of at least 185° F., for a period of several minutes to an hour. This can be accomplished by flooding the components with hot water or a hot cleaning and sterilizing solution or a combination thereof.

Previous designs of bottle filler machines are customarily provided with a cleaning and sanitizing system of some kind but they are not capable of providing a true hot sterilizing process. Typically such machines have a water heater and liquid flow controls and timers which permit the bottle filling valves to be flushed with hot water or hot cleaning liquid. The hot liquid in the cleaning process in the old machines is simply dumped on the floor where it is drained away to the waste water system. Since the water is wasted the system of the previous apparatus cannot be operated long enough to insure sterilization of the critical components of the bottle filler machine. Furthermore, the critical components are not completely flooded in the cleaning process.

The following patents relate to apparatus for sanitizing container filling apparatus but they do not solve the problem to which the present invention is directed nor have its advantages of efficiency and convenience:

U.S. Pat. No. 3,430,639 (1969) to Roberts;

U.S. Pat. No. 3,513,024 (1970) to Culliton;

U.S. Pat. No. 3,945,411 (1876) to Skoli et al; and

U.S. Pat. No. 4,024,896 (1977) to Ishioka et al.

The improved apparatus and method according to the present invention provides accessory equipment which is permanently or temporarily installed on the bottle filler machine and provides the capability of completely flooding all critical components of the apparatus with hot sanitizing liquid for as long as necessary, normally a few minutes to an hour. The hot water or sanitizing liquid is re-circulated within the apparatus (except for an insignificant portion flushed through the snift valves). Reduction of the amount of water used is, of course, an advantage, but the saving in energy required to heat the water is perhaps even more important.

In apparatus according to the present invention hot water or hot sanitizing solution is directed from the carbo-cooler through the filler bowl and the filler valves where it contacts all surfaces which the beverage comes in contact with. The flow rate for the liquid may be from ten to 40 gallons per minutes and the liquid is collected from the filler valves and returned to the CIP tank in a continuous re-circulating process. This procedure takes place while the filler machine table and valves are rotating at the normal rate or at a slightly reduced rate. Certain parts of the machine, such as the bottle lifters, are disabled for the sanitizing operation. The snift valve operating mechanism is active however, and each snift valve is flushed with hot water or sanitizing solution once during each rotation of the machine. Typical bottle filler machines to which the present apparatus may be attached are the Crown Uni-Blend 60/15 filler, or the Crown Uni-Blend 45/6 filler. With slight modifications apparatus according to the present invention may be added to most similar beverage bottle filler machines which in general are improvements and modifications to apparatus as shown in W. J. Sommers U.S. Pat. No. 2,847,043 issued Aug. 12, 1958.

Typically the manifolds for collecting solution from the filler valves will be provided with collector tubes to collect from five filler valves. Thus, with a 50-valve filler machine, ten manifolds will be required. A rotating collector is permanently installed at the top of the machine and stainless steel tubes with Teflon inner lining connect each of the ten manifolds to an inlet port in the rotating collector.

It is preferred that the filler bowl be completely flooded and accordingly the liquid level controls for the filler bowl are disabled, and a further flexible stainless steel tube with Teflon inner lining is connected from the overflow of the filler bowl to the rotating collector. In the usual arrangement each manifold is provided with a jack which rests on the rotating conveyor and is used to hold the manifold in an upward position firmly against the filler valve seals. Preferably all bottle lifters are disabled so that they remain in the lower position.

The manifolds and the jacks are installed for the sanitizing procedure and removed when the pocedure is completed. The other equipment, including the rotating collector and the tubes, remain on the machine during normal filling operations. The tubes are connected to the manifold by a quick connect fitting and dummy fittings are installed on the rotating conveyor to retain the ends of the tubes during normal filling operations so that they cannot interfere with such operations.

Bottle filler machines are normally provided with sources of hot and cool water, means for providing washing or sanitizing solutions, pumps for fluid circulation, and timing controls which may be emloyed in the hot sanitizing procedure of the present invention. In the event that a bottle filler lacks any of these features it may be readily supplied from commercially available products. The complete operation of apparatus according to the invention will be described following the detailed description of the apparatus.

In addition to providing the above described advantages and features, it is an object of the present invention to provide apparatus for hot sanitizing conventional bottler filler machines, including manifolds and a rotating collector through which hot sanitizing solution may be circulated to flood all portions of the apparatus exposed to the product during normal filling operations.

It is another object of the invention to provide hot sanitizing apparatus consisting of relatively simple and inexpensive attachment apparatus which in part may be permanently installed without interfering with the normal filling operation or otherwise readily removed to return the apparatus to its normal bottle filler configuration.

It is another object of the present invention to provide a hot sanitizing procedure for beverage bottle filler machines wherein essentially all of the sanitizer liquid is re-circulated to conserve water and the energy required to heat the water.

Other objects and advantages will be apparent from consideration of the following description in conjunction with the appended drawings in which.

Figure 1:
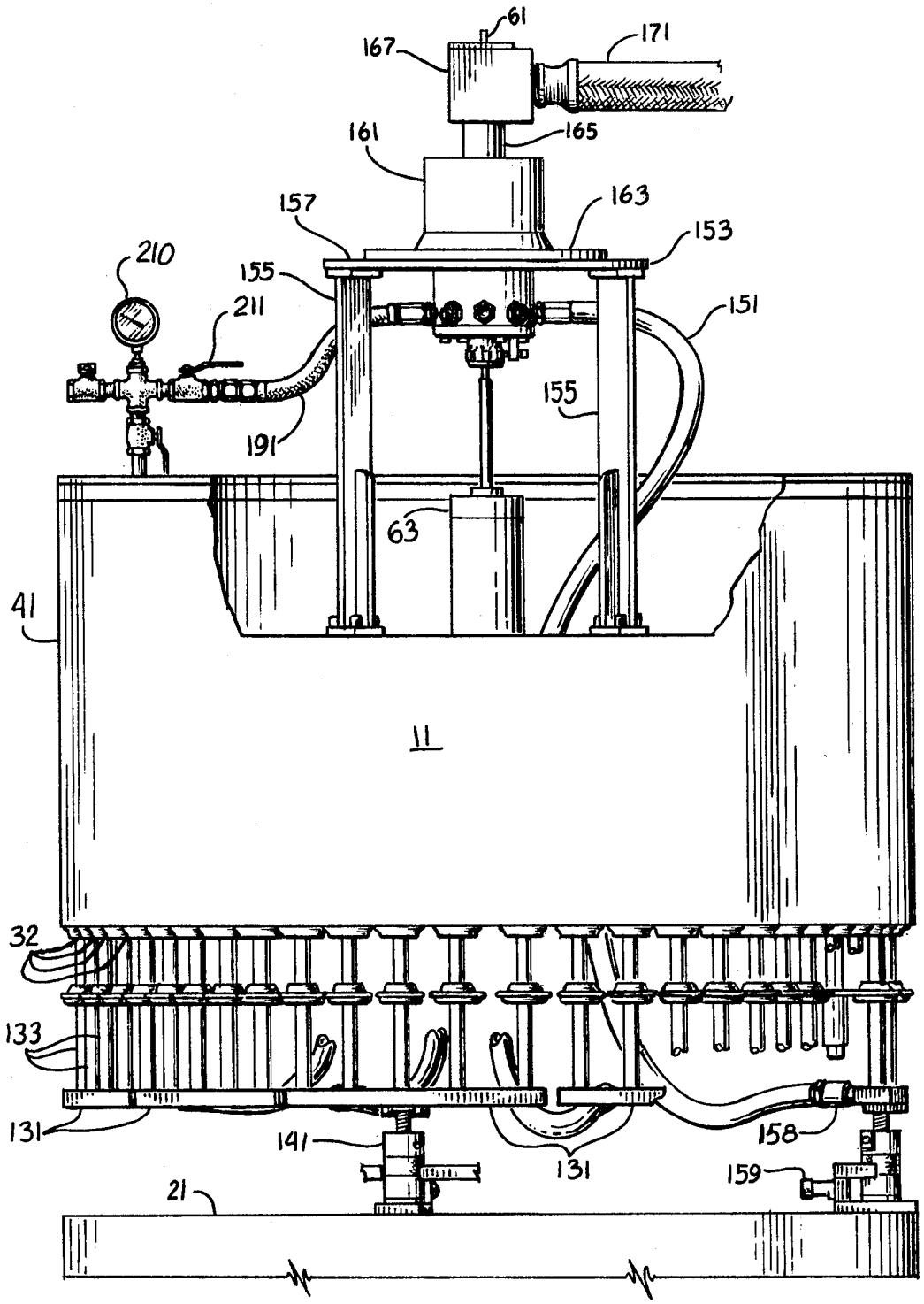
FIG. 1 is a side elevational partially fragmentary view of a portion of a conventional bottle filler machine with apparatus according to the present invention installed thereon.

Referring to the drawings and particularly FIG. 1, a bottle filler machine 11 of generally conventional construction is shown having a filler bowl 41. Extending from the bottom of the filler bowl 41 are a plurality of bottle sealer elements 32 which form the bottle portion of filler valve assemblies 31. The filler valve assemblies 31 are built into the filler bowl 41 and are not visible in FIG. 1 except for the bottle sealer elements 32.

As is well-known, the filler machine 11 in normal operation rotates and beverage bottles to be filled are fed onto the rotating conveyor 21; each bottle in succession is raised to contact its respective sealer element 32 and the bottle is filled by the operation of filler valve assemblies 31 in a well-known manner.

In operation of the filler machine with the sanitizer system of the present invention there are, of course, no bottles fed to the rotating conveyor 21. Instead a plurality of manifold elements 131 are arranged to engage the sealer elements 32 of the filler valve assemblies 31 in essentially the same manner as they would be engaged by beverage bottles. Each manifold 131 has a plurality of upstanding tubes 133. In the embodiment illustrated in FIG. 1 there are five tubes 133 for each manifold 131. The total number of valves in the machine 11 is 50 so that ten manifolds 131 accommodate all valves of the machine. A greater or lesser number of tubes 133 may be provided on manifolds 131 but preferably not less than three. In some cases it may be necessary to use different manifolds with different numbers of tubes to accommodate all valves of a filler machine. For example, for 48 valves one might use nine 5-tube manifold plus one 3-tube manifold. The bottle filler machine disclosed herein is of a conventional type such as that produced under the name Crown Uniblend or as shown in prior patents such as U.S. Pat. No. 2,063,326, issued Dec. 8, 1936 to G. L. N. Meyer. The filler valve not shown in detail in the present application is generally similar to those shown in U.S. Pat. No. 2,896,675, issued July 28, 1959 to J. G. Voelker, or U.S. Pat. No. 2,847,043, issued Aug. 12, 1958 to W. J. Sommers.

Figure 5:
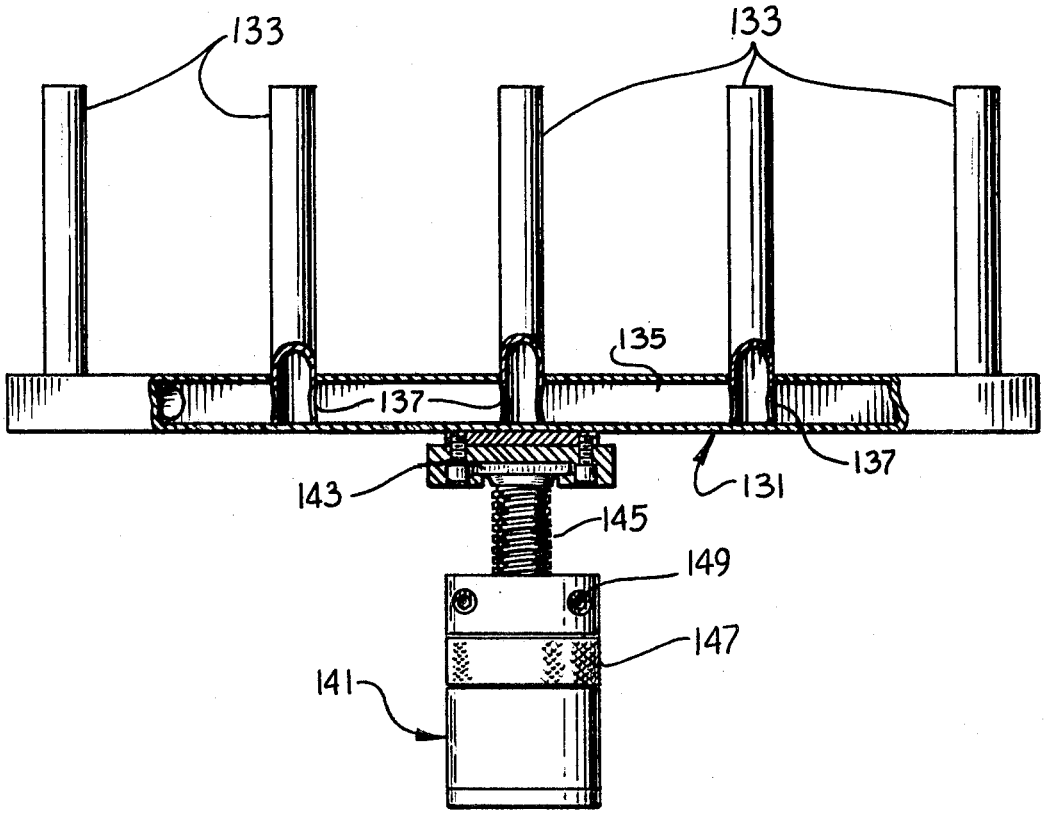
FIG. 5 is a side elevational, partially fragmentary, view of a jack and manifold according to the present invention.

Manifolds 131 are raised upward to firmly contact sealer elements 32 by a jack 141 which is shown in more detail in FIG. 5. The bottle lifters which are operative during the normal bottle filling operation are rendered inoperative during the sanitizing operation.

A raised platform 153 is secured on the filler machine to rotate with bowl 41. It includes legs 155 and annular plate 157. A rotating collector 161 is secured to plate 157 by machine bolts or other conventional means so that the flange 163 and external housing of the rotating collector rotates with platform 153 and the filler bowl 41. The rotating collector has a core pipe 165 which remains stationary and an elbow connector element 167, also stationary, connects to the core pipe 165. Liquid return tube 171 receives the sanitizing liquid and returns it to the system for re-circulation and reheating. Pipes, tubing, fittings, and other components which are in contact with the product are formed of stainless steel, Teflon, or other material accepted for food products handling applications.

A flexible tubing 151 connects from each of the manifolds 131 to the rotating collector 161. Tubing 151 may be flextube of stainless steel lined with Teflon. Preferably the flexible tubing 151 is permanently threaded at the top end into the rotating collector and has a quick connect fitting 158 at the lower end for connection to a manifold 131. This permits the manifold 131 to be removed quickly and easily while the flexible tubing 151 remains on the machine. A dummy connector 159 is provided to secure the end of flexible tubing 151 during normal operation of the machine so that it will not swing free and interfere with the normal filling operation. The tubing 151 is sealed at the lower end by dummy coupling 159 when not in actual use so that any contamination of the system is effectively prevented.

Figure 2:
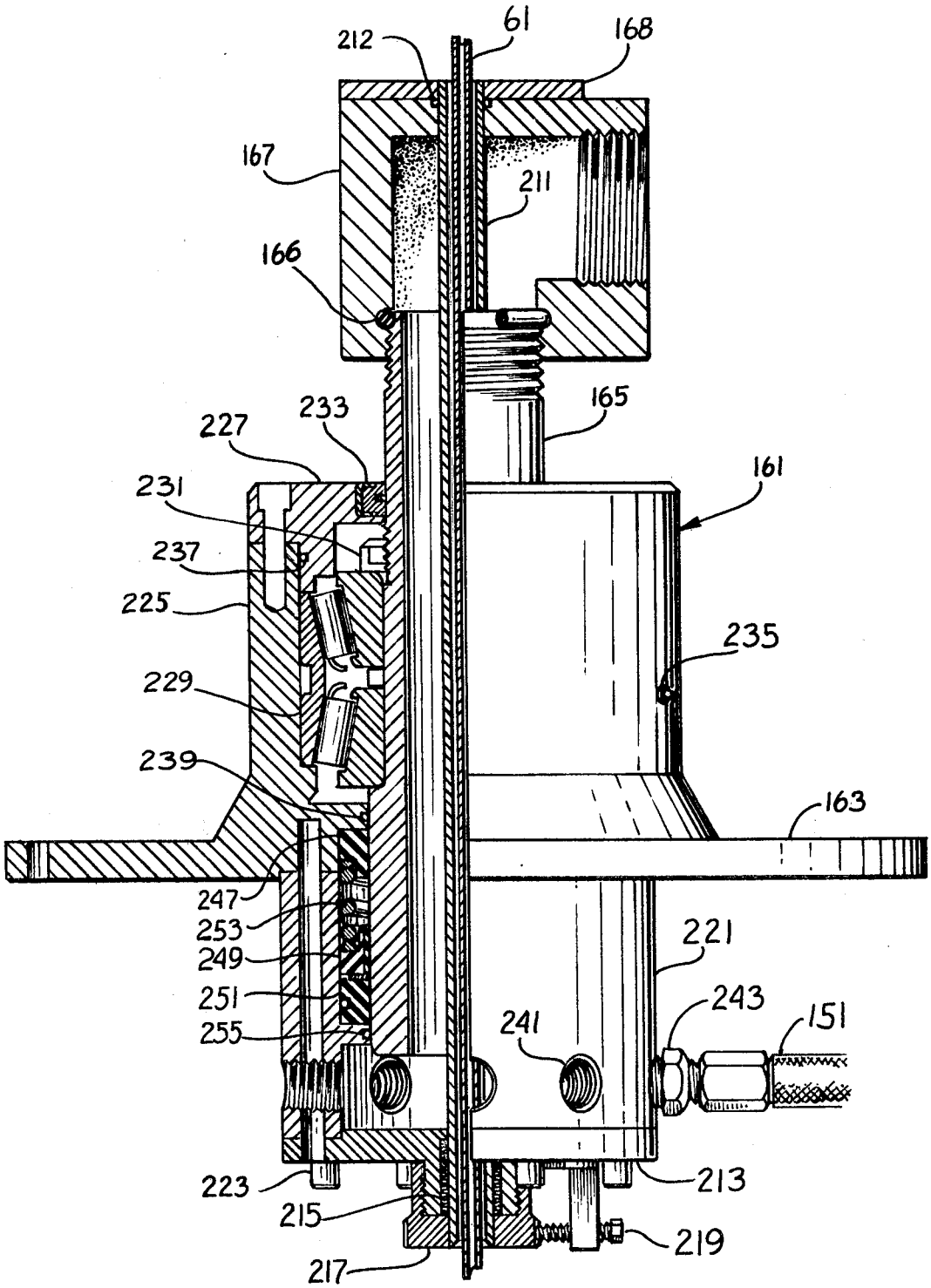
FIG. 2 is an enlarged, partially sectional, detailed view of the rotating collector device of the present invention.
Figure 3:
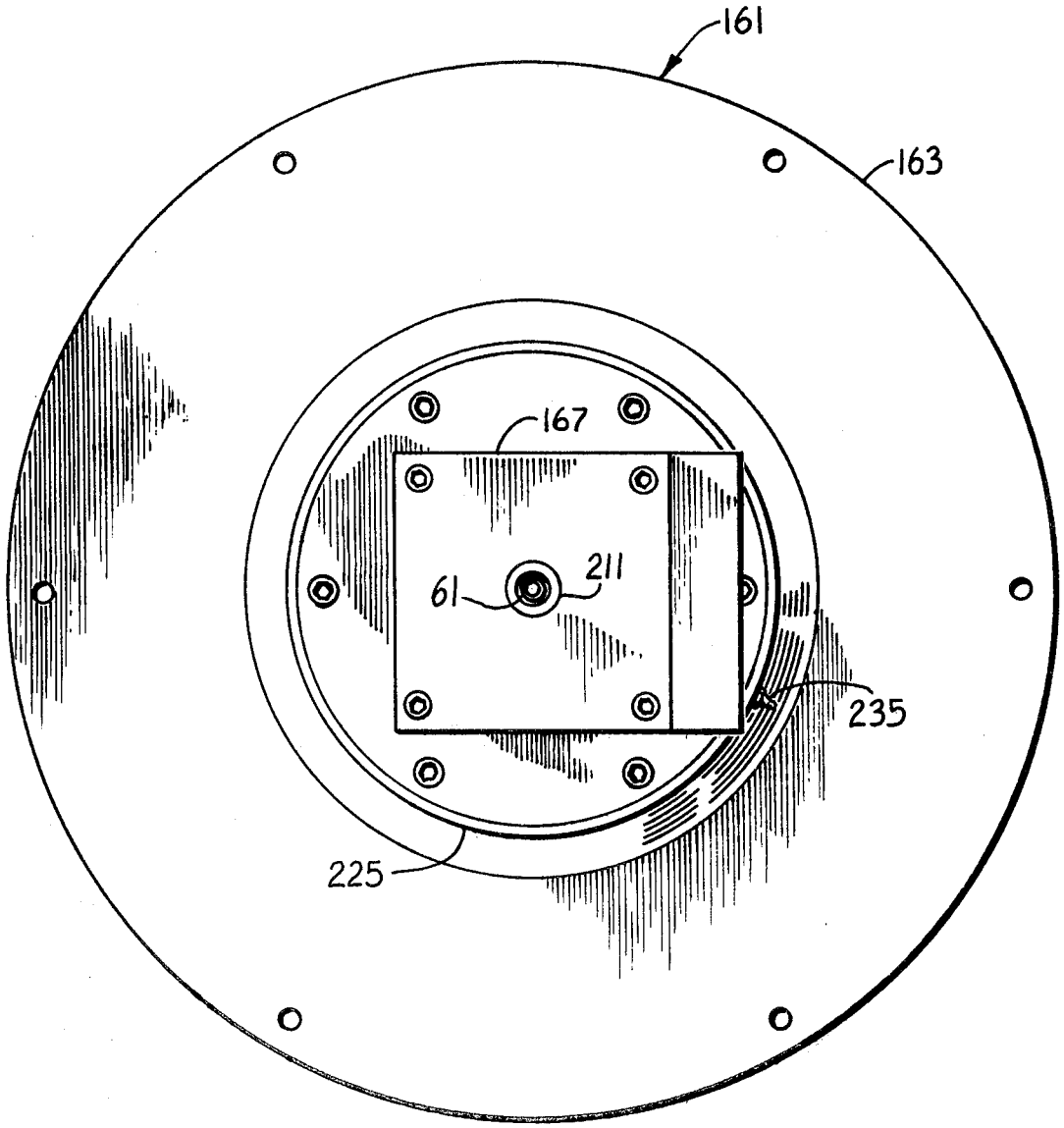
FIG. 3 is a top plan partially fragmentary view of the apparatus of FIG. 2.

Bottle filler machines of the type involved here are customarily supplied with carbon dioxide ($CO_2$) under pressure to maintain carbonation in the beverage product and for other purposes. The filler machine 11 is provide with a $CO_2$ line 61 which is stationary and passes freely through a central opening in rotating collector 161 inside core pipe 165. The $CO_2$ line 61 passes into a rotating coupling 63 and the $CO_2$ line is connected into the filler bowl by means not relevant to the present invention and not shown in FIG. 1. Rotating collector 161 is shown in more detail in FIG. 2.

The rotating collector 161 is mounted on the bottle filler machine concentrically with the axis of rotation of the machine. The $CO_2$ line 61 of the filler machine passes through the center of the rotating collector.

If the $CO_2$ line of the filler machine is of a diameter greater than $\frac{3}{8}$ths inches, it is preferably replaced with a $\frac{3}{8}$ths inch outside diameter line, at least for that portion which passes through the rotating collector 161. The $CO_2$ line 61 is stationary.

Due to the fact that the rotating joint 63 on the filler machine which retains the bottom end of $CO_2$ lines 61 is sometimes slightly off-center, the opening through the rotating collector to accommodate the $CO_2$ line 61 is larger than the outside diameter (⅜ths inch) of the $CO_2$ line. It may have an inside diameter of ¾ inch. This permits truly concentric mounting of rotating collector 161 even though rotating joint 63 is slightly off-center.

Interior tube 211 extends the length of the rotating collector 161 and provides the through-opening for $CO_2$ line 61. Interior tube 211 is stationary and a seal at the bottom thereof is provided by a rotating joint 213 including packing 215 and packing nut 217. Packing nut 217 is tightened to form a rotating liquid-tight seal around interior tube 211 and is locked by a locking screw 219. Rotating joint 213 is, of course, a rotating member and is secured to the bottom of the chamber 221 of rotating collector 161 by machine bolts 223 or other suitable means.

The bearing unit 225 of rotating collector 161 includes a flange 163 by which the rotating collector 161 is attached to annular plate 157 over the center of the rotatable filler bowl of the bottle filler machine 11. Bearing element 225 includes a cap 227 which may be secured in place by recessed machine bolts (not shown in FIG. 2). A double roller combination bearing 229, is mounted in bearing unit 225 and is held in place therein by cap 227. Chamber 221, bearing unit 225 and cap 227 rotate together as a unit with the rotating portions of the filler machine 11.

The internal races of bearing 229 slide onto core element 165 and bearing 229 is secured in place on core element 165 by collar 231 which threadedly engages core element 165. It will be noted that the rotating collector 161 is positioned longitudinally as well as radially on core element 165 by bearing 229 so that the only movement of bearing unit 225 relative to core element 165 is rotational. The top of bearing element 229 is provided with a conventional grease seal 233 and a grease fitting 235 is provided to facilitate lubrication of bearing 229. An O-ring 237 provides a tight seal between cap 227 and the side of bearing unit 225. An O-ring 239 provides a grease seal at the rotating joint between the bottom portion of bearing unit 225 and the core element 165.

Chamber element 221 is provided with a number of ports 241 for the connection of flexible tubing 151 through threaded fittings 243 or other suitable means.

The interior of chamber 221 communicates with the open bottom end of core element 165 and a rotating seal is provided between chamber 221 and core element 165 by a conventional packing element configuration including packing and sealing elements 247, 249 and 251 to which a loading force is applied by a spring 253. An additional O-ring seal 255 is provided below sealing packing element 251. The liquid tight rotating seal arrangement including elements 247, 249, 251, 253, and 255 is conventional and commercially available (for example 3.00 in. PK Seal by Garlock, Inc.), and may be replaced by other conventional liquid-tight rotating joint structures. As previously described the interior tube 211 is provided with a rotating seal as it passes through the bottom of chamber 221 by packing 215 and packing nut 217. Thus the top and bottom rotating joints for chamber 221 are provided with liquid tight seals and liquid entering through flexible tubing 151 is directed up through chamber 221, core element 165, elbow 167, and into pipe 171 for return to the fluid heating and handling system of the bottle filler installation. The connection between core element 165 and elbow 167 is sealed by O-ring 166. The top of interior tube 211 is sealed by O-ring 212 secured in place by plate 168.

Figure 4:
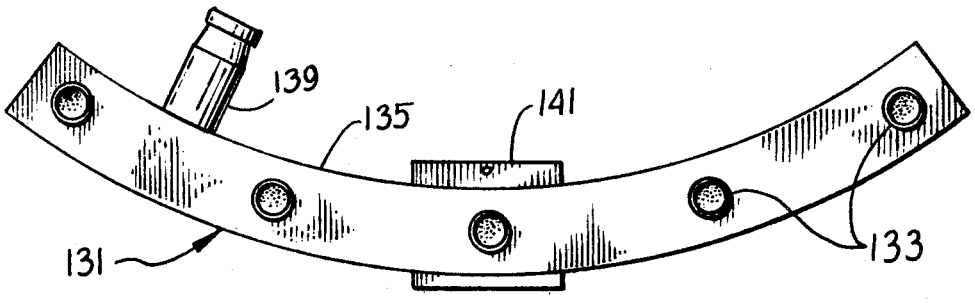
FIG. 4 is an enlarged top plan view of a manifold device according to the present invention.

The construction of manifolds 131 is clearly shown in FIGS. 4 and 5. Each manifold 131 includes a plurality of upstanding tubes 133 which communicate with the hollow base 135 of manifold 131. As shown in FIG. 5 the tubes 133 extend through the hollow interior of base 135 and communication is provided by openings 137 in the bottom of the side walls of the tubes 133.

The tops of tubes 133 are preferably smooth and free from indentations or sharp corners so that they make good contact with the filler valves in simulation of the contact between filler valve and bottle mouth. The diameter of tubes 133 is selected to be approximately equal to the bottle mouth diameter of the bottles for which the filler valves are intended. One quick connect fitting 139 is welded, brazed, sodered or otherwise secured to base 135 of manifold 131 and mates with a connector 157 on the end of flexible tubing 151.

Figure 6:
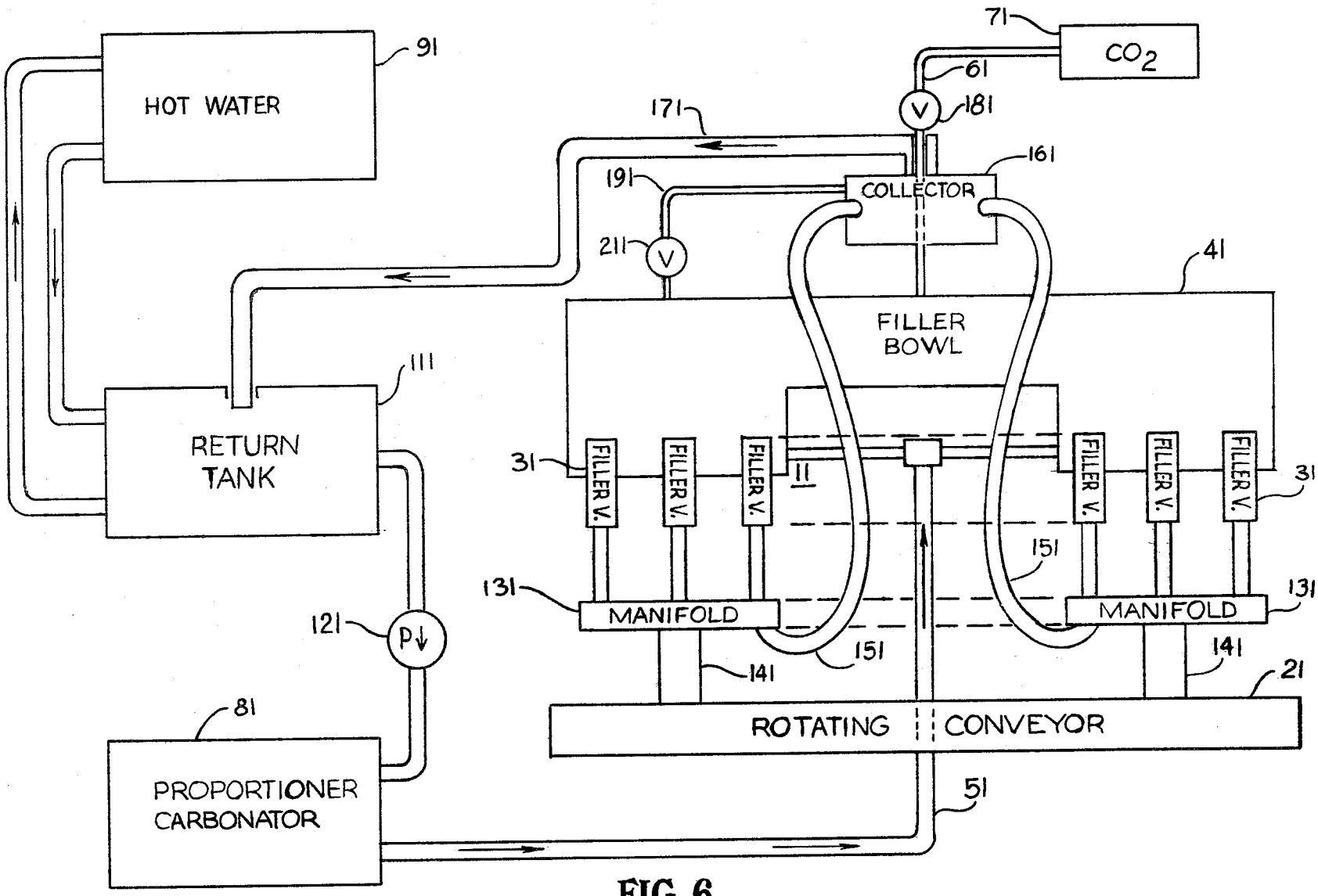
FIG. 6 is a schematic diagram of apparatus according to the invention, together with cooperating portions of conventional bottle filler machine apparatus.

A jack 141 of conventional construction is provided for each of the manifolds 131 and includes a head 143, a screw 145, a knurled adjustment ring 147, and set screws 149. The number of tubes 133 provided on each manifold may be varied, but is preferably no less than three. Five tubes as shown is a convenient number and if the number of filler valves is divisible by ten (or five) all valves can be accommodated without resorting to odd-sized manifolds. The box cross-section of the manifolds makes them quite rigid even though of relatively light construction; such rigidity is desirable so that force from the jack is approximately evenly distributed to the valves contacted by tubes 133. The overall operation of the system may be best understood by reference to FIG. 6. The bottle filler machine installation will normally be provided with sanitizing equipment including a hot water source 91, a return tank 111 connected to the hot water source 91 and provided with suitable controls for maintaining water temperature. A pump 121 transfers fluid under pressure to the proportioner carbonator 81 through which it flows to the filler bowl 41 of the filler machine 11. Also included but not shown in FIG. 6 are valves, conduits, and containers, whereby detergent, sanitizing fluid, water, and mixtures thereof may be introduced to the proportioner carbonator and to the filler bowl of the machine. In the event that such apparatus is not included in the existing installation, it would need to be added for optimum operation of the system according to the present invention.

The details of the sanitizing sequence would vary depending on the requirements of the particular system and the product characteristics but an example of the sequence might be (1) prerinse with cool treated water; (2) wash with detergent with one-half percent sodium hydroxide solution at 140° F. with ten minutes of re-circulation; (3) rinse with hot water at 140° F. five to ten minutes; (4) hot sanitize with water at 185° F. with fifteen minutes of re-circulation; (5) rinse with treated water to 140° F. for gradual cool-down.

As previously discussed the sanitizer system of the invention obtains various advantages by operating with the filler bowl and valves in motion. The conversion from the normal filling operation to the sanitizing operation is quite simple. There is, of course, no input of bottles to the filler in the sanitizing operation. Instead the jacks 141 are located on the rotating conveyor and utilized to secure manifolds 131 in place so that each filler valve is in sealing contact with and feeds into a respective upstanding tube 133 of a manifold 131. The jacks 141 and manifolds 131 are designed to properly engage the filler valves when the bottle lifters on the rotating conveyor are inoperative. Accordingly, the bottle lifters are deactivated for the sanitizing operation. Usually the liquid level in the filler bowl is controlled by a counter-pressure of $CO_2$ indicated by gauge 210 which in turn is adjusted by a float valve in the filler bowl. In the sanitizing operation it is desired that the filler bowl be completely flooded to insure that all parts of the apparatus are sanitized. Accordingly an overflow tube 191 similar to flexible tube 151 is connected to an extra port 241 on rotating collector 161. Valve 211 opens to connect the overflow port on the filler bowl through tube 191 to collector 161. At the same time the carbon dioxide source 71 is shut off by valve 181 with the result that filler bowl 41 fills with liquid and overflows through tube 191.

The rotating conveyor 21 is rotated, preferably at approximately one-half normal speed for product filling, and the valve opener is set in "open" position so that the valve operating cams turn the valves to open. The valve closing roller is disengaged so that all valves stay open during the sanitizing operation.

The particular fluid being used at a particular stage of the sanitizing operation fills the filler bowl to overflowing and flows through the filler valves into the manifolds 131 where the fluid is forced up through tubes 151 to collector 161. Sufficient fluid is provided so that the entire apparatus is flooded to above the level of collector 161. From collector 161 the fluid returns through stationary return pipe 171 to the return tank 111.

The bottle filler machine is customarily provided with snift valves which in the normal filling operation open momentarily to relieve pressure and foaming and facilitate a uniform fill of the beverage bottles. In the sanitizing operation the snift valves are preferably allowed to operate in their normal manner so that each snift valve is opened as it passes the snift cam and heated solution passes through the snift valve. In this manner each and every component of the bottle filler apparatus is exposed to the sanitizing solution at elevated temperature and complete sanitization is assured.

At the end of the procedure cool water will be in the filler bowl and it may be drained to the floor drain in a conventional manner through a product line drain valve.

Flexible tubes 151 are disconnected from manifolds 131 and the ends thereof are secured in place on dummy couplings 159. The jacks 141 are lowered and they, together with the manifolds 131, are removed from the bottle filler machine rotating conveyor 21. The desired adjustments are then made to the machine to ready it for a normal product filling operation.

While a preferred embodiment of the invention has been illustrated and described, it should be noted that numerous variations and modifications might be made to the apparatus. For example, the number of filler valve-accommodating tubes on each manifold may be different and the shape of the manifold may vary from the arcuate shape illustrated. The jacks 141 may be replaced by a different mechanism to hold the manifolds in position and that mechanism might be built into the manifold itself if desired. The quick disconnect fittings 157 are very convenient but they are not essential to the operation of the device. The particular manner in which fluid connections are made from the rotating filler valve assembly to the stationary return line may be modified from the rotating collector arrangement shown. While the $CO_2$ line 61 is shown running freely through an opening through the center of rotating collector 161, one may instead connect the $CO_2$ line to the bottom of the rotating collector and connect another portion to the top so that the passage through the rotating collector forms a part of the $CO_2$ conduit. The flexible return line 171 is utilized to permit raising and lowering of the filler bowl and valve assembly in a customary manner. A rigid return line 171 might be substituted in a manner that would accommodate any necessary raising or lowering of the filler bowl and valve assembly.

In addition to the variations and modifications to the apparatus of the invention described or suggested above, other modifications and variations will be apparent to those skilled in the art and accordingly the scope of the invention is not to be considered limited to the particular embodiments illustrated, described or suggested, but is rather to be determined by reference to the appended claims

What is claimed is:

1. A sanitizer system for a beverage container filler machine having a rotating bowl and associated circular array of filler valves, a reservoir and a rotating conveyor comprising a plurality of collector manifolds, each having an outlet opening and at least three upwardly extending tubes with lips at the top thereof adapted to seal against seals of filler machine valves, said tubes being in an arcuate arrangement with a radius corresponding to that of a filler machine valve array, means for holding each said manifold in a raised position on said rotating conveyor to cause all of its tubes to seat and seal against corresponding valves of said bottle filling machine and to receive liquid flow from said valves when open, a plurality of flexible hoses, each connectable at one end to one of the outlet openings of said manifolds, a stationary return pipe connected to said reservoir, a rotating collector located above said bowl and having a plurality of inlets with said hoses connected thereto and a rotatable, liquid-tight connection with said return pipe, whereby a liquid return path is provided from said manifolds through said rotatable liquid-tight connection to said stationary return pipe and to a reservoir.

2. Apparatus as recited in claim 1 wherein said collector is arranged with the rotatable connection to said return pipe coaxial with the axis of rotation of said rotating conveyor.

3. Apparatus as recited in claim 1 wherein said bottle filler machine includes a filler bowl and said sanitizer system further includes a hose with one end connected to receive overflow from said filler bowl and the other end connected to said collector.

4. Apparatus as recited in claim 1 wherein said means for holding each said manifold in a raised position includes a plurality of adjustable jacks adapted to be placed between the top surface of said rotating conveyor and the bottom of one said manifolds.

5. Apparatus as recited in claim 1 further including means secured to said rotating conveyor for retaining the ends of said hoses when disconnected from said manifolds.

6. A method of sanitizing a bottle filler machine having a reservoir, a rotating conveyor and a rotating bowl with a circular array of filler valves comprising the steps of placing a plurality of collector manifolds on said conveyor, each manifold having upwardly extending tubes with lips at the top thereof vertically aligned with seals of filler machine valves, supporting said manifolds in a raised position on said conveyor in a position to receive liquid flow from all said valves when open, connecting a plurality of flexible hoses, one on each of said manifolds, said hoses being connected at the other end to a rotating collector located above said bowl having a rotatable, liquid-tight connection with a stationary return pipe, opening said valves, causing introduction of hot washing liquid from said reservoir into said bowl to flow by gravity through said valves, producing a pressure head in said manifolds sufficient to cause said valves and bowl to be flooded, and recirculating said washing liquid through said manifolds, said hoses, said collector, said return pipe and said bowl.

7. A method as recited in claim 6 further including the step of rotating said bowl, valves, manifolds and conveyor in unison.

8. A method as recited in claim 7 wherein said valves include snift valves and further including the step of causing said snift valves to sequentially be opened as they rotate past a fixed point adjacent to said circular array of filler valves.

9. A sanitizer system for a beverage container filler machine having a rotating bowl and associated circular array of filler valves, a stationary reservoir and a rotating conveyor comprising a plurality of collector manifolds, each having an outlet opening and at least three upwardly extending tubes with lips at the top thereof adapted to seal against seals of filler machine valves, said tubes being in an arcuate arrangement with a radius corresponding to that of a filler machine valve circle, means for holding each said manifold in a raised position to cause all of its tubes to seat and seal against corresponding valves of said bottle filling machine and to receive liquid flow from said valves when open, means for producing a fluid pressure head in said manifolds sufficient to maintain flooding of said bowl and valves including a plurality of flexible hoses connectable to outlet openings of respective ones of said manifolds, and means for providing a liquid return conduit from said manifolds through said hoses to a stationary reservoir when said manifolds are secured on a rotating conveyor of a bottle filler machine, said means for providing a liquid return conduit including a rotating collector located above said bowl connected to receive liquid from said hoses, a stationary return pipe connected to said stationary reservoir and a rotatable liquid-tight connection between said collector and said pipe, whereby said cleaning liquid is recirculated through said rotating bowl and associated array of filling valves while the filler machine is rotating.

10. Apparatus as recited in claim 9 wherein said means for holding each said manifold in a raised position includes a plurality of adjustable jacks adapted to be placed between the top surface of said rotating conveyor and the bottom of one said manifold.

11. Apparatus as recited in claim 9 wherein said collector is arranged with the rotatable connection to said return pipe coaxial with the axis of rotation of said rotating conveyor.

12. Apparatus as recited in claim 9 wherein said bottle filler machine includes a filler bowl and said sanitizer system further includes tubing with one end connected to receive overflow from said filler bowl and the other end connected to said collector.

13. Apparatus as recited in claim 9 further including means secured to said rotating conveyor for retaining the ends of said hoses when disconnected from said manifolds.

* * * * *